US009047762B1

(12) United States Patent
Neuville et al.

(10) Patent No.: US 9,047,762 B1
(45) Date of Patent: Jun. 2, 2015

(54) DISPLAY MODES FOR A LARGE AREA DISPLAY SYSTEM

(71) Applicants: Bradley J. B. Neuville, Marion, IA (US); James S. Pruitt, Marion, IA (US); Aaron C. Williams, Cedar Rapids, IA (US); John M. Amidon, Marion, IA (US)

(72) Inventors: Bradley J. B. Neuville, Marion, IA (US); James S. Pruitt, Marion, IA (US); Aaron C. Williams, Cedar Rapids, IA (US); John M. Amidon, Marion, IA (US)

(73) Assignee: Rockwell Collins, Inc., Cedar Rapids, IA (US)

( * ) Notice: Subject to any disclaimer, the term of this patent is extended or adjusted under 35 U.S.C. 154(b) by 103 days.

(21) Appl. No.: 13/771,671

(22) Filed: Feb. 20, 2013

(51) Int. Cl.
*G08B 21/00* (2006.01)
*G08G 5/00* (2006.01)

(52) U.S. Cl.
CPC ..... *G08G 5/0021* (2013.01)

(58) Field of Classification Search
None
See application file for complete search history.

(56) References Cited

U.S. PATENT DOCUMENTS 8,159,464 B1 * 4/2012 Gribble et al. ..... 345/173

* cited by examiner

*Primary Examiner* — Travis Hunnings
(74) *Attorney, Agent, or Firm* — Angel N. Gerdzhikov; Donna P. Suchy; Daniel M. Barbieri

(57) ABSTRACT

The display system includes a display having a touchscreen input device. A processing system is operatively associated with the display. The display operates in a number of fixed modes. Each fixed mode has a single fixed format, each single fixed format having at least one fixed region, wherein the at least one fixed region has configurable overlay options. In an aircraft application the plurality of fixed modes are selected from the group of flight modes consisting of navigation, air-to-air (A-A), emergency, air-to-ground (A-G), preflight checklist and system status. In a preferred embodiment the emergency mode includes functionality to conserve power.

18 Claims, 9 Drawing Sheets

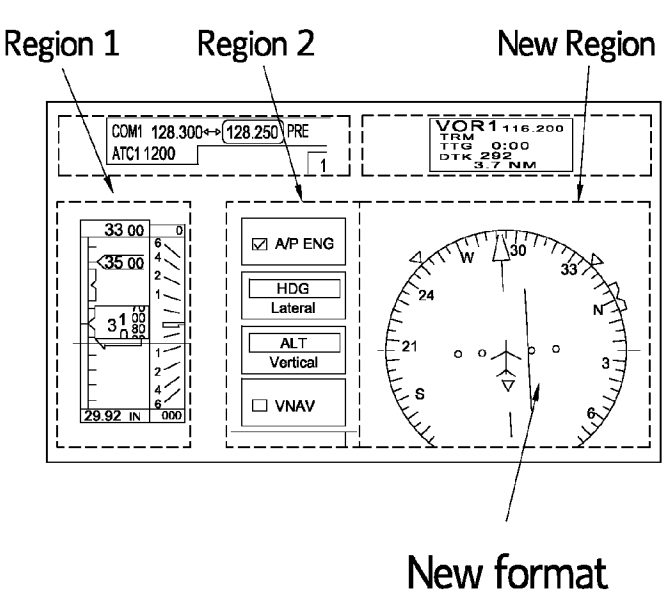
FIG. 1
Prior Art
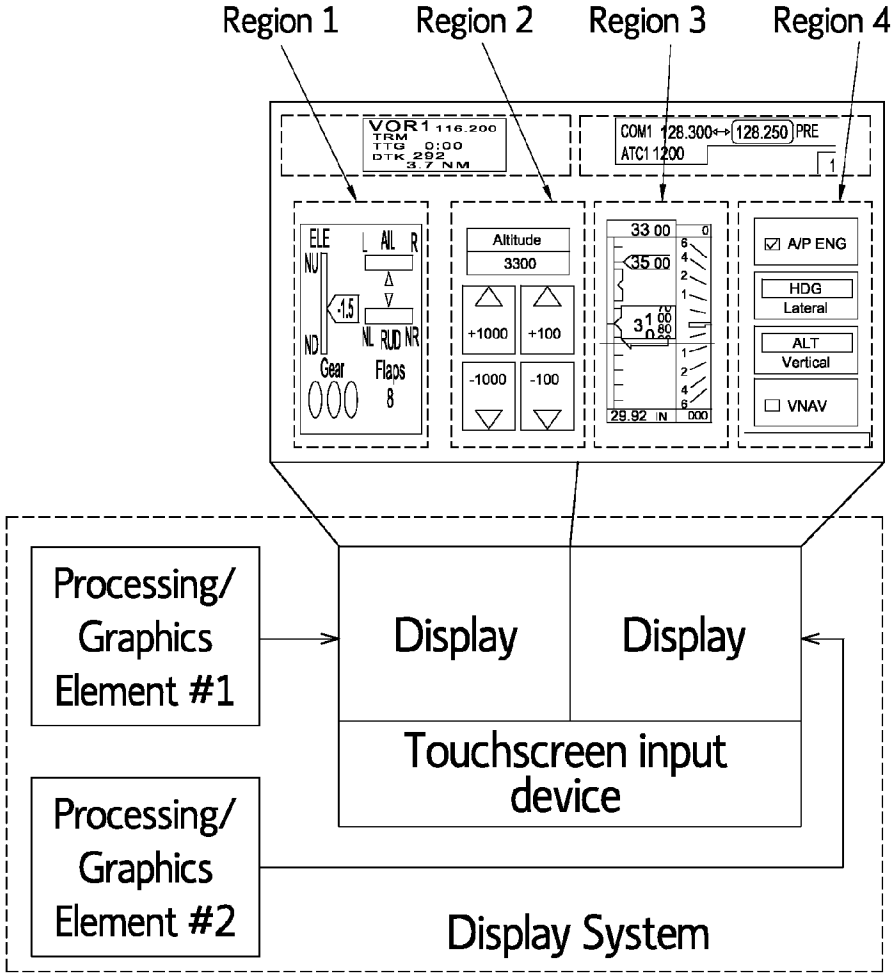

Nav Mode Format

Nav Mode Format

A-A Mode Format

A-A Mode Format

DISPLAY MODES FOR A LARGE AREA DISPLAY SYSTEM

BACKGROUND OF THE INVENTION

1. Field of the Invention

The present invention relates to display systems and more particularly to display modes for large area display systems.

2. Description of the Related Art

For many years, systems have been modifying display formats based upon vehicle operational regime or vehicle input conditions (e.g. engine failure). In many cases, these regimes or conditions are considered or labeled "modes" of operation. However, as capabilities have increased, so too have the demands on the vehicle and the operator. Larger displays demand increased power. Larger displays allow system designers to increase the amount of information being displayed to the operator and maximize configurability, but also significantly increase operator training time to utilize the system.

Traditionally, increased information and capability has come with increased configurability. As more information is displayed and controlled and more display area is available, more and more options and configurability has been designed into systems. New cockpits use a single large area display (e.g. 8 inch by 20 inch active area) instead of several smaller displays. Modern tactical cockpits integrate enormous amounts of sensor fusion. Typical legacy display sizes that are suited for small fighter cockpits do not have enough viewable surface area to accurately depict sensor fusion to the pilot. Since the advent of the F-35 aircraft, many platforms are realizing the benefits of a large area display and are moving to incorporate one as a new install or retrofit. The current F-35 large area display has limitations that do not fully utilize the large display surface. For example, it cannot draw down the middle of the display; its graphical interface partitions the 8×20 display into four 5×7 windows, and if one side of the graphics processor fails, that half of the display blanks. FIG. 1 (Prior Art) is a simplified block diagram of the display system presently used in existing large area display systems. These display systems typically include more than one display, specifically more than one Liquid Crystal Display laminated in a fashion to appear as one large area display. (The example of FIG. 1 illustrates two displays.) When the user touches the touchscreen as shown in the top left portion of FIG. 1, a myriad of region and format options may be activated. For example, a new region and a new format may be generated by the processing graphics elements of the display system, as shown in the top right portion of that Figure. Additional region, format, and configuration options are available. One feature of the current display system design is that the display region and format options available to the operator are significant. This allows each operator to configure the displays formats as they specifically desire. However, this also significantly increases training time as the operator has to learn the rules by which display regions and formats are configured in order to safely operate the vehicle.

Although the single large area display enhances the human interface, the large backlight can draw excessive battery power under emergency situations. The battery may not last long enough for the pilot to land safely.

SUMMARY OF THE INVENTION

In a broad aspect, the present invention is a display system for a vehicle. The display system includes a display having a touchscreen input device. A processing system is operatively associated with the display. The display operates in a plurality of fixed modes. Each fixed mode has a single fixed format, each single fixed format having at least one fixed region, wherein the at least one fixed region has configurable overlay options.

In the present applicants' preferred embodiment, the vehicle is an aircraft and the plurality of fixed modes are selected from the group of flight modes consisting of navigation, air-to-air (A-A), emergency, air-to-ground (A-G), preflight checklist, and system status.

Thus, the large glass surface area provides the ability to present significantly greater information to the operator, without the traditional confines of multiple individual pieces of smaller glass. This freedom allows the ability to tailor display images to display all information a user would require in an optimized, single format without the need for complex configurability.

In a preferred display system where there is a fixed mode comprising an emergency mode and corresponding fixed emergency mode format, the emergency mode of operation of the vehicle requires significantly minimized power consumption. Such a display system includes a critical graphics channel (CGC) for receiving critical data from a host platform and creating a critical image output. A noncritical graphics channel (NCGC) receives critical data from the host platform and creates non-critical image outputs. The NCGC includes a power control input. An image merge element receives the critical image output and non-critical image outputs and combines them into a liquid crystal display (LCD) drive signal. An LCD receives and displays the LCD drive signal. A backlight is positioned behind the LCD including strings of light emitting diodes (LEDs), to illuminate the LCD, wherein selected LEDs are located behind the critical data in an area of the LCD define an Emergency Zone. An optical diffuser is positioned between the LED strings and the LCD to provide uniform illumination. At least one current source is connected to the LED strings, including means for controlling the voltage of the LED strings. Current sinks are connected to the LED strings for driving the LED strings. The current sinks are turned on and off by a pulse width modulation (PWM) signal. A backlight controller is connected to the at least one current source and to the plurality of current sinks for setting the current and pulse width to the LED strings to control the display brightness, wherein the backlight controller receives an Emergency Mode input signal from the host platform. When the backlight controller receives the Emergency Mode input signal from the host platform, only the backlight behind the Emergency Zone is illuminated, and power is turned off to the non-critical graphics channel in order to conserve power during the Emergency Mode.

BRIEF DESCRIPTION OF THE DRAWINGS

FIG. 1 (Prior Art) is a simplified block diagram of the display system presently used for existing large area display systems.

The same elements or parts throughout the figures of the drawings are designated by the same reference characters, while equivalent elements bear a prime designation.

DETAILED DESCRIPTION OF THE INVENTION

Figure 2:
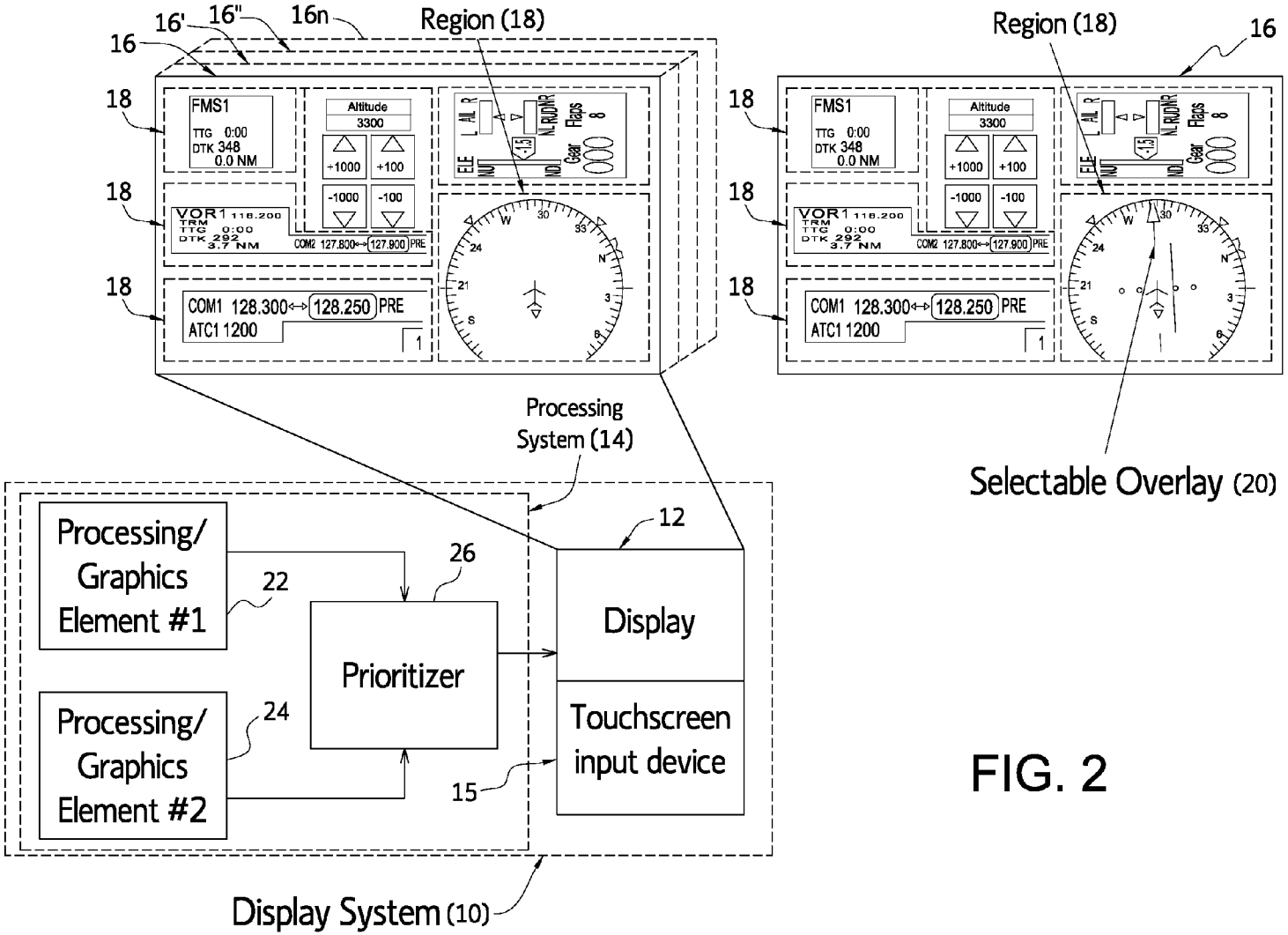
FIG. 2 is a simplified block diagram of the display system of the present invention.

Referring again to the drawings and the characters of reference marked thereon, FIG. 2 illustrates the display system for a vehicle, in accordance with the principles of the present invention, designated generally as 10. The display system 10 includes a display 12 and a processing system 14. The display 12 includes a touchscreen input device 15. The processing system 14 is operatively associated with the display 12, such that the display 12 operates in a plurality of fixed modes. Each fixed mode has a single fixed format, as shown by numeral designations 16, 16', 16", . . . , 16$''''$. (Formats 16', 16, 16", . . . , 16$''''$ are shown in phantom lines to illustrate that these are different formats on the same physical display.) Each single fixed format has at least one fixed region, generally a number of regions 18. At least one fixed region has configurable overlay options 20.

The display 12 may be a liquid crystal display (LCD) driven by an array of light emitting diodes (LEDs). The touchscreen input device 15 may be, for example, a digital resistive touchscreen laminated to the LCD which interprets user touch commands and passes those commands to the processing system 14.

The processing system 14 may include, for example, a combination of general or special purpose processing. It may have a set of special purpose input/output processing devices to interpret vehicle signals. It may have general purpose processing for performing higher order operations on the vehicle signals. It may generate images in software from the general purpose processing, being then interpreted by a special purpose graphics engine for interface to an image merge.

The processing system 14 preferably includes a first processing element 22 operatively connected to the touchscreen input device 15 for processing output signals from the touchscreen input device 15 to provide a first set of potential display action functions. A second processing element 24 processes output functions from the touchscreen input device 15 to provide a second set of potential display action functions. A prioritizer 26 (i.e. image merge) receives the first set of potential display action functions and the second set of potential display action functions and applies a set of priority driven rules for determining the display action. Additionally, the prioritizer 26 receives both the first set and second set of display images from the special purpose graphics engine and applies a set of priority driven rules for determining which display image to enable on the display 12. Thus, the prioritizer provides for a redundant set of control and display functions. The first processing element 22 and the second processing element 24 may be implemented as separate units or as an integral processing element. The prioritizer 26 allows either processing element 22 or 24 to control display functions in a cooperative manner. The prioritizer 26 is necessary to prevent control interference between processors, which could result in misleading operation.

The processing system preferably includes a smart control feature which limits controls associated with a display function to only those required in the given fixed mode, wherein when the smart control feature is activated no other display feature can grant access to the same controls. In a given mode, the control of functions are limited in the same way that the display is limited to that mode. It is limited only to the things that are relevant for that mode of operation. For example, say the total available list of controls for the Comm 1 radio are the following: Preset list setup; Frequency tuning; Satcom setup; Crypto setup; Guard; and, datalink receive. In A-A mode, the operator would only have access to frequency tuning, guard and datalink receive functions since the setup items are already setup and not important. In the preflight checklist mode, the operator would have access to all the setup items but not datalink receive since it is not required on the ground. Another feature involves the access point for changing. The access point for changing, for example in this case, the access point for changing the Comm 1 radio features, may be by touching whatever feature is displayed (in this case the frequency). Additionally, this is, preferably, the only method the operator would have to change the Comm controls (i.e., there is no other display access point to tune the radio, for example).

The regions 18, e.g. touch regions, may provide different types of input modalities. For example, the touch region 18 may comprise a touchable menu structure on the touchscreen upon touching thereof, or touching it may provide an on/off toggle.

For ease in use, the fixed touch regions 18 may be highlighted visually when the display touch function is activated outside of a fixed touch region. The highlighting may be accomplished by means of, for example, translucent shading or display of a border around the fixed touch region. It may appear in response to a touch outside a fixed touch region, or in response to a control input of any other type. Furthermore, the highlighting may be temporary (lasting until the touch or control input is removed), time-limited (lasting for a fixed duration after a touch or control input), or permanent (lasting until a second touch or control input occurs).

As used herein, the term "modes" is defined as: operational conditions of the vehicle wherein the necessary vehicle operations are less than the total of possible vehicle operations. For example, in an aircraft application, when the aircraft is on the ground, weight on wheels, after engine start, the preflight checklist mode would not include radar display, map display, etc. (Another example is in an automobile . . . an automobile set to park may be considered to be in "park mode" as not all operations (e.g. wheel movement, speedometer, etc.) are necessary.)

As used herein, the term "fixed" is defined as: set statically in hardware and/or software such as to not allow configurability by the vehicle operator.

A "format" is defined as: the image presented to the vehicle operator on the display in a given mode.

A "region" is defined as: a subsection of a given format generally configured with graphics or images of like function or interest to the operator.

An "overlay option" is defined as: a graphic or image within a region which may or may not be displayed, based upon operator selection.

In an aircraft application the plurality of fixed modes include flight modes including, for example, navigation, air-to-air (A-A), emergency, air-to-ground (A-G), preflight checklist and system status. Some of the modes (for example "emergency") can be automatically selected by the display system 10 based upon input conditions other than the operator selecting it. For example, if the display system is in navigation mode and is displaying the navigation format, then receives an input that an engine has failed, the display system would automatically set the mode into emergency and therefore the format would change to the emergency format without input from the operator. Another example may be when, in an aircraft application, the aircraft is on the ground, weight-on-wheels; just after engine start the display automatically switches to an airport diagram depicting aircraft present position on the aerodrome to facilitate appropriate taxi-way and runway selection. In an aircraft environment, the display may have a viewable width of approximately 20 inches and a viewable length of approximately 8 inches. In such an aircraft environment, the viewable width is preferably greater than 15 inches and the viewable length greater than 5 inches in order to allow enough display surface area to provide the capability to display all required information in a particular mode.

A unique aspect of the present invention is that each fixed mode has a single fixed format. Each fixed format utilizes the display area in such a manner as to display all information the operator may need at any point during operation of the vehicle in that particular mode. Additionally, each single fixed format has at least one fixed region. In many cases, a fixed format may have a plurality of fixed regions; however, in all cases each region is fixed in that no configurability of the placement, size, shape or orientation of the region is allowed by the operator. Overlay options 20 may exist within at least one fixed region to allow certain display artifacts to be displayed to the operator within the region. These options are generally constrained to regions with high amounts of display artifacts, wherein the ability to selectively control the presentation of the artifact by the operator may be required to ensure proper interpretation of the artifact or of surrounding artifacts by the operator. In limited circumstances the option might be zero.

Figure 3A:
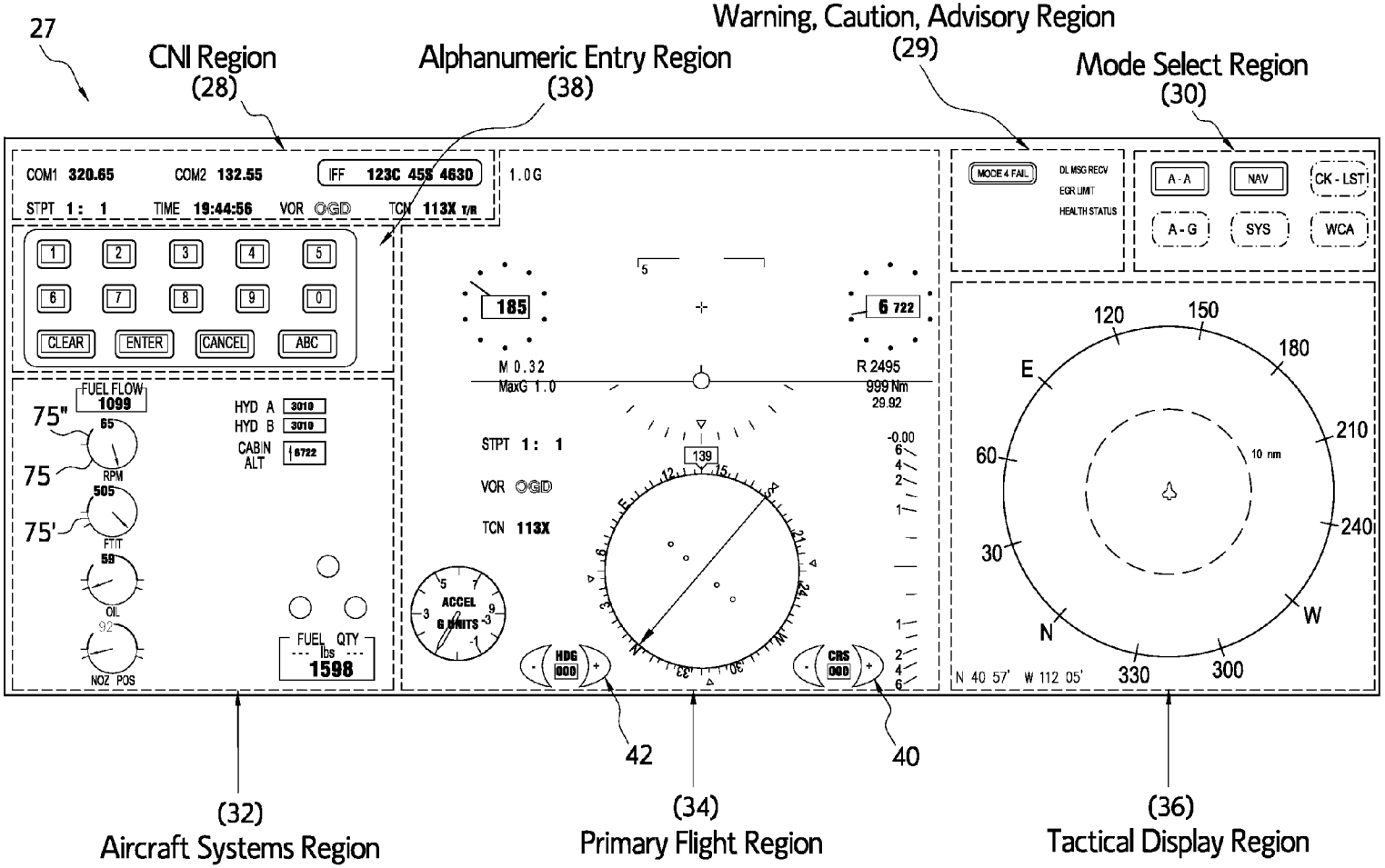
FIG. 3A is a representative flight display with a navigation format.
Figure 3B:
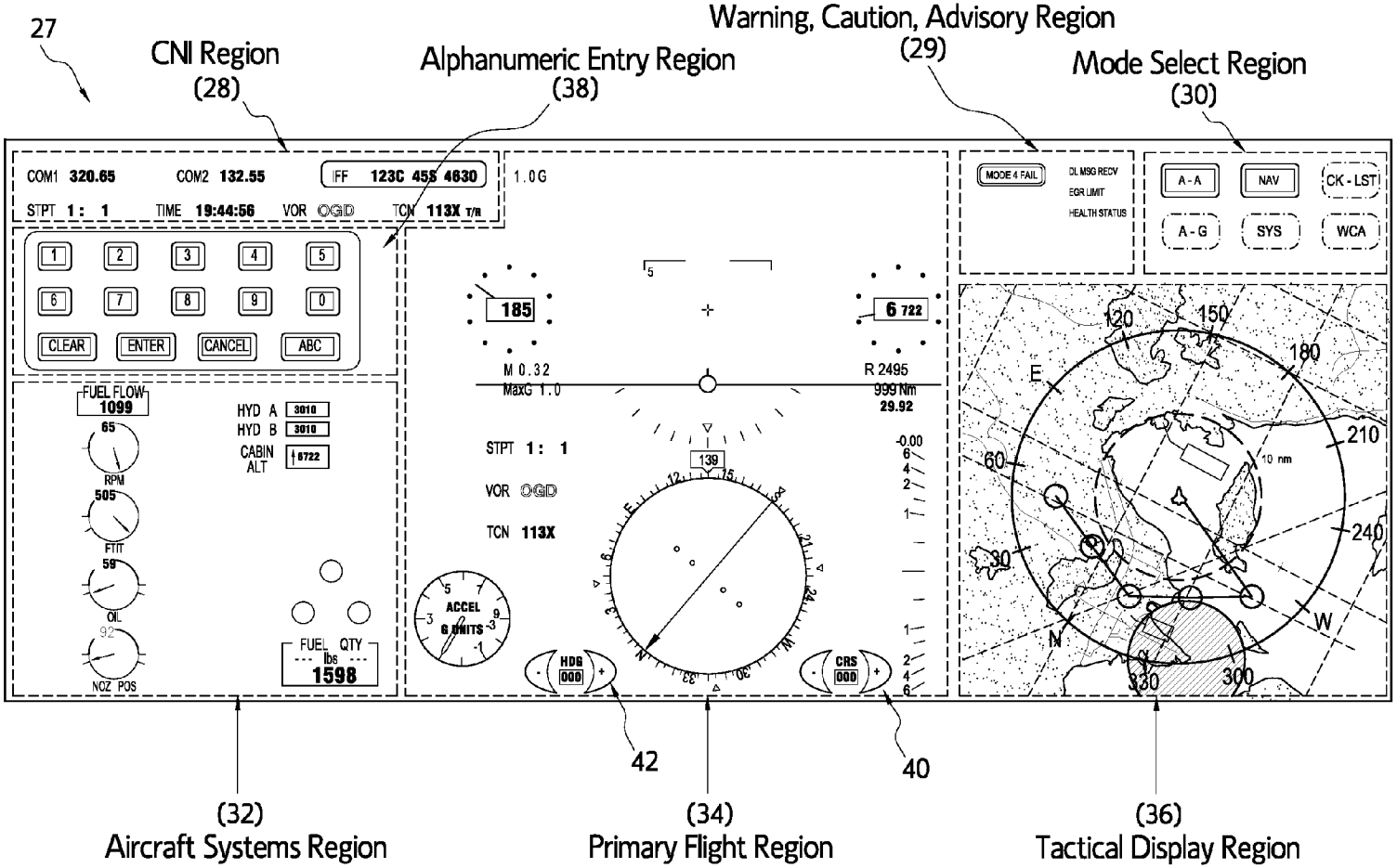
FIG. 3B illustrates the flight display with the navigation format of FIG. 2A but with a different set of overlay options.

Referring now to FIG. 3A, an example navigation mode format is shown, designated generally as 27. The navigation mode format includes a Communication Navigation Identification (CNI) region 28; a Warning, Caution, Advisory Region 29; Mode Select Region 30; Aircraft Systems Region (32); Primary Flight Region (34); Tactical Display Region (36); and, Alphanumeric Control Region (38). The Tactical Display Region (36) includes concentric circles, as discussed below in detail with respect to FIG. 4A. Referring now to FIG. 3B, when still in that navigation mode format 24, the overlay option can be changed in the Tactical Display Region (36). In this example, configurable overlay options (39) include the flight plan, digital map, data link points, and navigation aids, as shown. Other overlay options for the tactical display region in the navigation mode may be the same as discussed below with respect to the tactical display region in the air-to-air mode.

In a preferred embodiment the Primary Flight Region (34) includes a compass rose positioned in a lower central region of that Primary Flight Region. A course control (40) is positioned on one side of the compass rose and a heading (42) control is positioned on another side of the compass rose. These features include a label (e.g. CRS for course and HDG for heading), a readout indicating exact value of course or heading to the nearest whole degree located beneath the readout and two partially spherical-appearing touch control areas partially surrounding each readout, with a "–" symbol within the left partially spherical-appearing area indicating the ability to decrease and a "+" symbol within the right partially spherical-appearing area indicating ability to increase. Additionally within this Primary Flight Region are other display elements such as airspeed, mach number, altitude, attitude, pitch, roll, yaw, course indicator, vertical speed, etc.

In a preferred embodiment, the Alphanumeric Control Region (38) includes squares with rounded edges containing within them alpha or numeric representations of numbers from 0-9 and English alphabet letters. In order to constrain the size of the region, only letters or numbers are visable at any one time, with the control between letters and numbers provided by another button represented as a square with a rounded edge containing the letters ABC.

The Aircraft Systems Region (32) preferably includes colors to indicate status as will be explained below in detail.

Figure 4A:
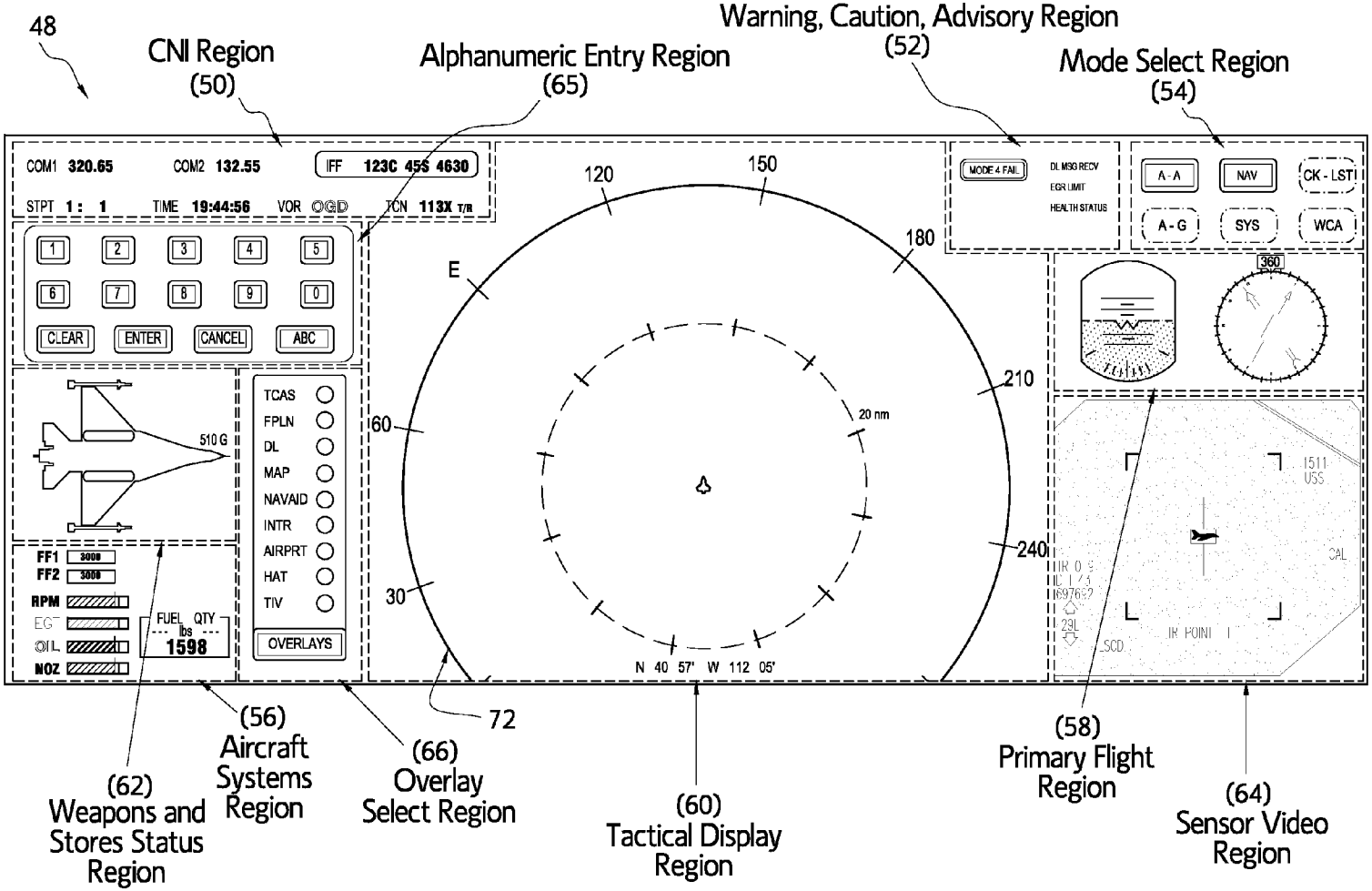
FIG. 4A is a representative flight display with an air-to-air (A-A) format.

Referring now to FIG. 4A, an example air-to-air (A-A) mode format is shown, designated generally as 48. The A-A mode format (48) includes a Communication Navigation Identification (CNI) region (50); a Warning, Caution, Advisory Region (52); Mode Select Region (54); Aircraft Systems Region (56); Primary Flight Region (58); Tactical Display Region (60); Weapons and Stores Status Region (62); Sensor Video Region (64); Overlay Select Region (66); and, Alphanumeric Entry Region (65).

Figure 4B:
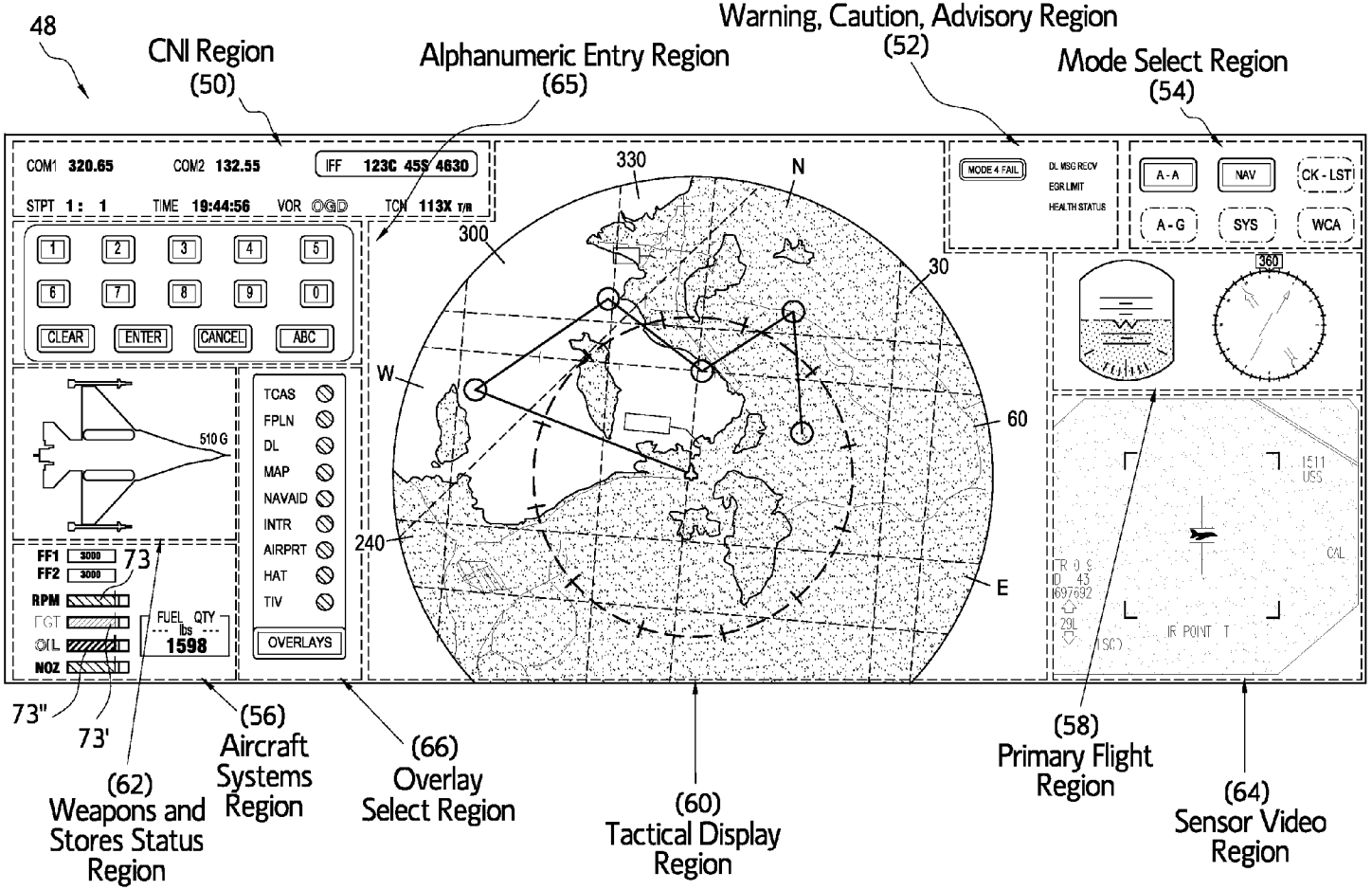
FIG. 4B illustrates the flight display with the A-A format of FIG. 3A but with a different set of overlay options.

Referring now to FIG. 4B, when still in that A-A mode format (48), the overlay option can be changed as depicted within the Tactical Display Region (60) by enabling the display of overlay information as selected in the Overlay Select Region (66) to include, for example, a graphical representation of the flight plan (i.e. FPLN). Other overlay options may include TCAS, Digital Map (MAP), Navigation Aids (NAVAID), Threat intervisibility (TIV), height above terrain (HAT), airports (AIRPRT), and datalink points (DL). As in the last embodiment, each region is fixed in that no configurability of the placement, size, shape or orientation of the region is allowed by the operator.

In a preferred embodiment, the A-A mode format includes a large Tactical Display Region (60) (e.g. greater than 40% of the total display surface area). The Tactical Display Region includes a circular horizontal plan view (72). Additionally, increments of 30 degrees are depicted around the outside of the circle for reference. Within the circular A-A format are a set of layered artifacts which provide the operator graphical representation of the entire field of battle. All layered artifacts are confined for display within the confines of the outer concentric circle 72. (With conventional displays having this view, the map and datalink/flight plan points are often displayed outside the confines of the outer circle. The region they are displayed within is often a rectangular region. With the present invention, maximum use of space is achieved by confining the map, etc. to be within the concentric circle.

Referring still to FIGS. 4A and 4B the Aircraft Systems Region (56), in the lower left area of the display, includes a major aircraft systems health region with components therein displayed as a function of normal or abnormal status. In a preferred embodiment the display of normal or abnormal status would be illustrated by color. In a preferred embodiment, the illustration of the colors would include green for normal status, yellow for cautionary status and red for abnormal status. These three states are represented by numeral designations 73, 73', 73" where the prime indication indicates a different color. This embodiment of the display of major aircraft systems health is useful in those formats where primary operator functions are focused on other tasks than monitoring major aircraft systems health.

Referring again now to FIG. 3A, a major aircraft systems health region includes a specific readout of status, generally in numerical form and often a dial or tape indicating a degree or percentage of the overall limit of the system. During modes where such detail is unimportant, a display of the major aircraft systems health in a normal or abnormal sense decreases the operator's workload on a task which is of low importance during that mode of operation. The three states mentioned above are represented by numeral designations 75, 75', and 75". The number readouts preferably have a color indicating a normal or abnormal sense (i.e. green, yellow, or red).

Referring now to FIGS. 3A and 4A, the alphanumeric entry region (38) is positioned at the same area on the display in each mode (as are the other regions). This affixment of the alphanumeric entry region to each mode allows the operator to achieve the positive muscle memory that is achieved in many existing designs which utilize a hardware alphanumeric entry device. This positive muscle memory allows reduced operator training time and increased user efficiency by ensuring explicit placement of alphanmeric control functions, regardless of the vehicle mode. Preferably, all of the fixed modes include an alphanumeric entry region positioned at the same area on the display.

The Air-to-Ground (A-G) mode and preflight checklist and system status mode related formats are not specifically shown but include similar regions as discussed above. The A-G mode declutters information more relevant for A-A missions and helps the pilot focus on key A-G delivery parameters and considerations. The preflight checklist and system status provide a summary display to help the pilot quickly and efficiently complete actions to prepare the aircraft for taxi/take-off. The System Status mode provides higher levels of detail on status of aircraft subsystems. During typical operations, the system status mode information would be hidden, and would only become visible (prioritized) when an aircraft malfunction was present.

Figure 5:
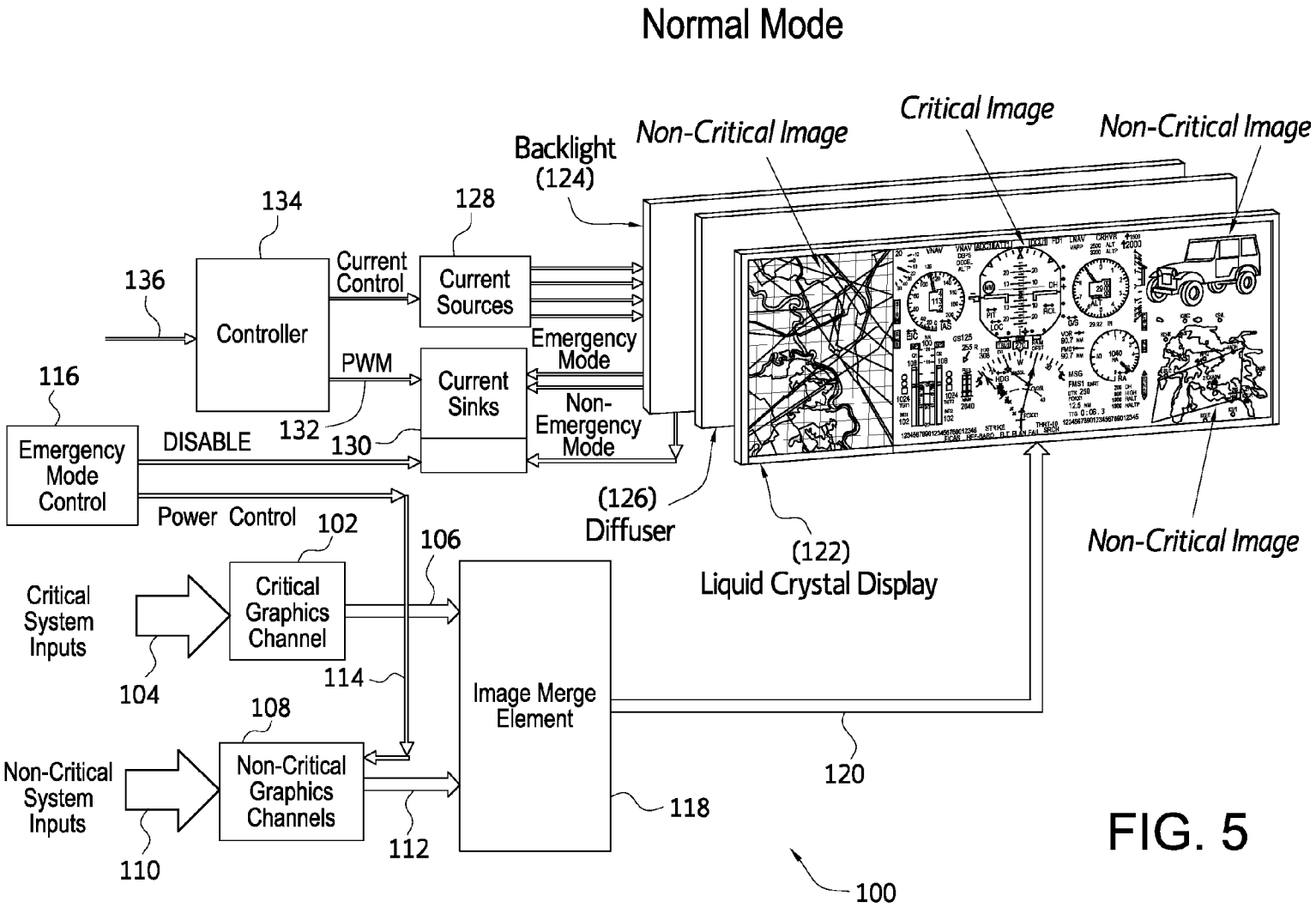
FIG. 5 is a schematic block diagram illustrating the display unit of the present invention, during a normal mode of operation.

Referring now to FIG. 5, a display system, designated generally as 100 is illustrated, in accordance with the principles of the present invention, in which an emergency mode is implemented with specialized hardware. A critical graphics channel (CGC) 102 receives critical data 104 from a host platform and creates a critical image output 106. The critical graphics channel (CGC) 102 includes signal interface electronics, processing, memory, and image rendering electronics. The CGC 102 may be part of the processing system discussed above with respect to FIG. 2. The host platform may be any system that must function on limited power during an emergency situation.

A noncritical graphics channel (NCGC) 108 receives critical data 110 from the host platform and creates non-critical image outputs 112. The NCGC 108 includes a power control input for receiving power control signals from an emergency mode control 116. This input is a bi-level input with two states, normal mode and emergency mode. The input may be manually generated by an operator switch, or automatically generated by system monitoring software.

An image merge element 118 receives the critical image output 108 and non-critical image outputs 112 and combines them into a liquid crystal display (LCD) drive signal 120. An LCD 122 receives and displays the LCD drive signal 120. The image merge element 118 includes circuitry that combines each pixel of the image inputs in a prioritized manner such that critical images are legible for any state of the non-critical images. The image merge element 118 outputs a composite critical and noncritical image when both inputs are active. When the noncritical image is turned off, the image merge only passes the critical image.

A backlight 124 is positioned behind the LCD 122. As will be discussed below in detail, the backlight 124 includes strings of light emitting diodes (LEDs), to illuminate the LCD. Selected LEDs are located behind the critical data in an area of the LCD defining an Emergency Zone.

An optical diffuser 126 is positioned between the LED strings of the backlight 124 and the LCD 122 to provide uniform illumination. The optical diffuser 126 may comprise a transparent, light-scattering material. An example of a commercially available optical diffuser is such an optical diffuser by Luminit, LLC, Torrance, Calif., marketed under name Light Shaping Diffuser™.

At least one current source 128 is connected to the LED strings of the backlight 124. The current sources 128 include means for controlling the voltage of the LED strings. Each current source 128 includes circuitry that sources a current controlled to set display brightness. Typically, the circuitry includes a transistor whose conductivity is controlled by a current sensing resistor in order to provide a precise current. It may be, for example, a Linear Technology LT3598 LED driver, sold by Linear Technology Corp., Milpitas, Calif.

A plurality of current sinks 130 are connected to the LED strings for driving the LED strings. The plurality of current sinks 130 are turned on and off by a pulse width modulation (PWM) signal 132. The current sinks 130 include circuitry to cause current to flow in the connected LED string at the duty cycle set by the PWM 132. A typical current sink uses a Vishay Siliconix SI3440DV field effect transistor.

A backlight controller 134 is connected to the current source(s) 128 and to the current sinks 130 for setting the current and pulse width to the LED strings to control the display brightness. The backlight controller 134 is configured to receive an Emergency Mode input signal 136 from the host platform. An example of a suitable controller is an NXP LPC2368 microcontroller. This highly integrated device includes an ARM7 processing core, memory, and peripheral interfaces (such as a pulse width modulator) that can drive and monitor multiple strings of LEDs.

Figure 6:
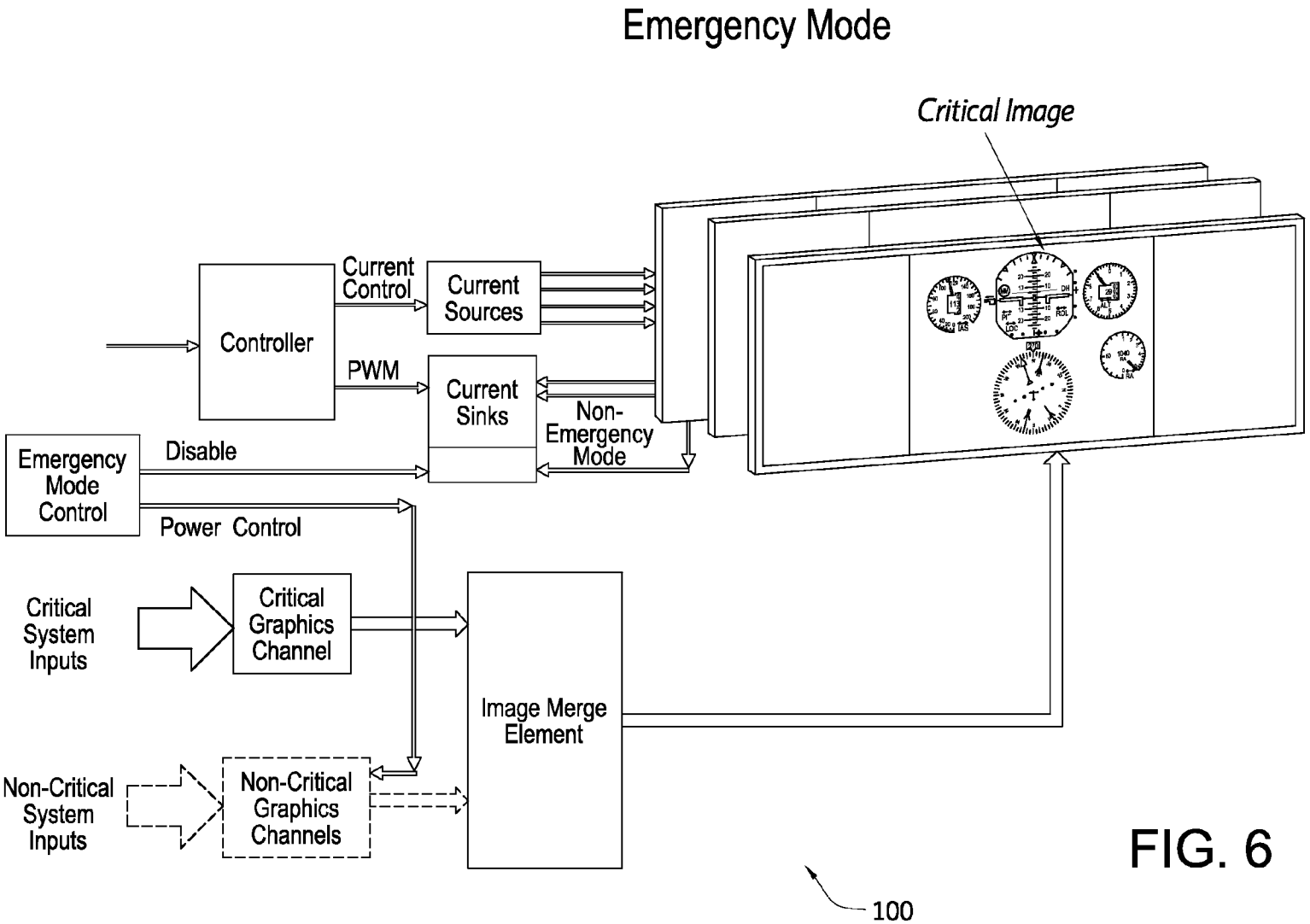
FIG. 6 shows operation during an emergency mode.

During operation, when the backlight controller 134 receives the Emergency Mode input signal 136 from the host platform, only the backlight behind the Emergency Zone is illuminated, and power is turned off to the non-critical graphics channel in order to conserve power during the Emergency Mode. This transition is illustrated in FIG. 6. As can be seen in this figure, the critical image, defining the Emergency mode format, is positioned preferably in a central portion of the display. The NCGC 108 shown in phantom lines is unpowered by the power control signal.

Figure 7:
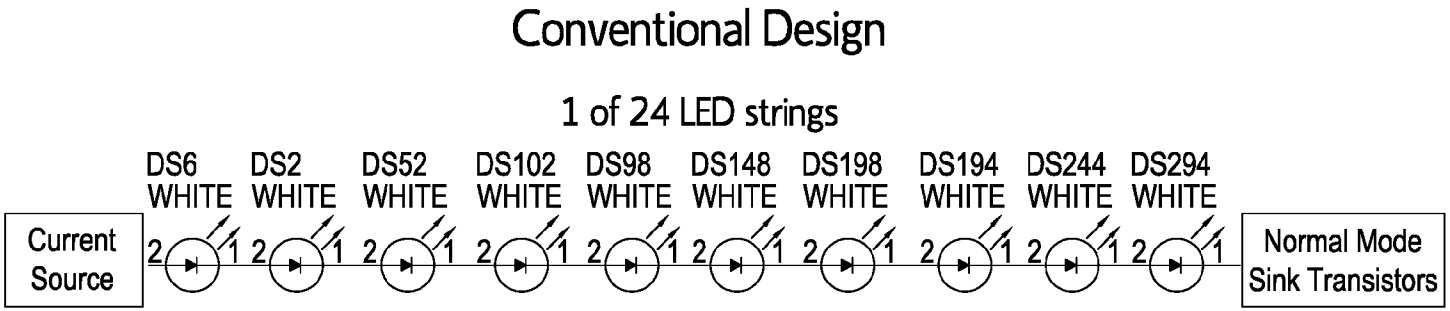
FIG. 7 Prior Art
FIG. 7 (Prior Art) is a schematic illustration showing the light emitting diode drive used in current products.
Figure 8:
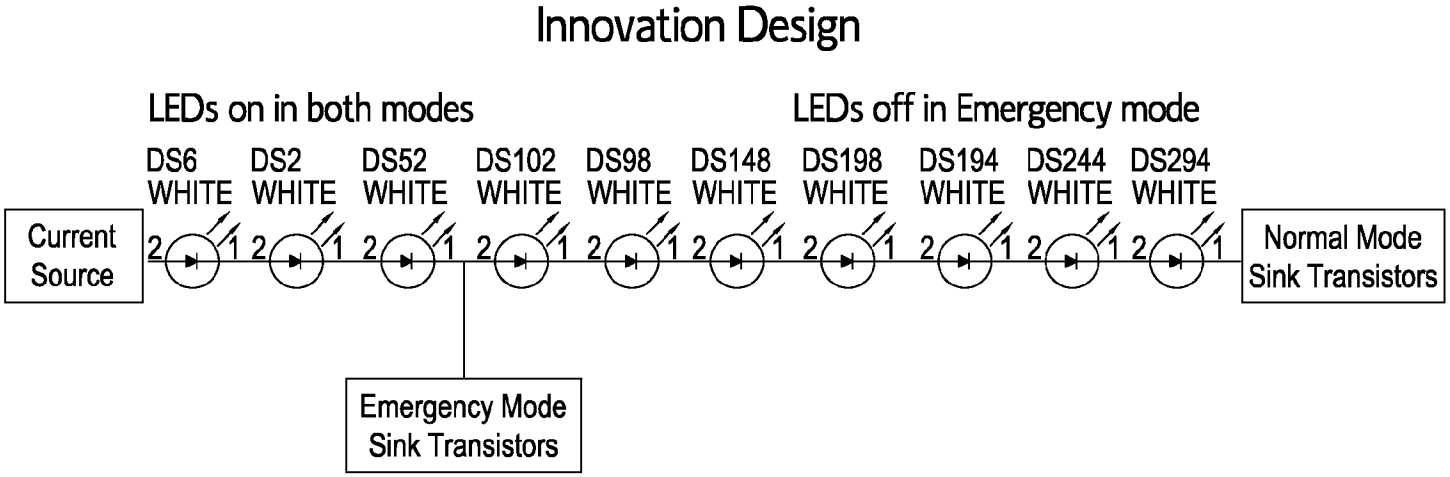
FIG. 8 is a schematic illustration showing utilization of the present inventive principals to drive a subset of the light emitting diodes.

Referring now to FIG. 7 (Prior Art), one of the twenty-four LED strings in an existing LED backlit display system is illustrated. This design is commonly used in high-brightness cockpit display units. Use of parallel redundant strings provides a usable display even if an LED fails and a string "opens". The LEDs are spatially distributed so that a failed string does not cause a dark band on the display. In a preferred embodiment of the present invention, as shown in FIG. 8, an LED string is illustrated in accordance with the principles of the present invention. A set of emergency mode sink transistors sink current from the LEDs when activated by the PWM. Current sinks which are not behind the Emergency Zone strings are de-activated by the Emergency Mode signal. Current and voltage are reduced only when the Emergency Zone strings are driven, to provide the same brightness as in the non-Emergency mode.

The inventive concepts herein can be implemented for a variety of potential applications. For example, although the invention has been described with respect to an aircraft it could be used in automobile applications, space vehicles, or other systems needing to operate from limited power under an emergency condition.

The foregoing detailed description has set forth various embodiments of the devices and/or processes via the use of block diagrams, flowcharts, and/or examples. Insofar as such block diagrams, flowcharts, and/or examples contain one or more functions and/or operations, it will be understood by those within the art that each function and/or operation within such block diagrams, flowcharts, or examples can be implemented, individually and/or collectively, by a wide range of hardware, software, firmware, or virtually any combination thereof. In one embodiment, several portions of the subject matter described herein may be implemented via Application Specific Integrated Circuits (ASICs), Field Programmable Gate Arrays (FPGAs), digital signal processors (DSPs), General Purpose Processors (GPPs), Microcontroller Units (MCUs), or other integrated formats. However, those skilled in the art will recognize that some aspects of the embodiments disclosed herein, in whole or in part, can be equivalently implemented in integrated circuits, as one or more computer programs running on one or more computers (e.g., as one or more programs running on one or more computer systems), as one or more programs running on one or more processors (e.g., as one or more programs running on one or more microprocessors), as firmware, or as virtually any combination thereof, and that designing the circuitry and/or writing the code for the software/and or firmware would be well within the skill of one skilled in the art in light of this disclosure.

In addition, those skilled in the art will appreciate that the mechanisms of some of the subject matter described herein may be capable of being distributed as a program product in a variety of forms, and that an illustrative embodiment of the subject matter described herein applies regardless of the particular type of signal bearing medium used to actually carry out the distribution. Examples of a signal bearing medium include, but are not limited to, the following: a recordable type medium such as a floppy disk, a hard disk drive, a Compact Disc (CD), a Digital Video Disk (DVD), a digital tape, a computer memory, etc.; and a transmission type medium such as a digital and/or an analog communication medium (e.g., a fiber optic cable, a waveguide, a wired communication link, a wireless communication link (e.g., transmitter, receiver, transmission logic, reception logic, etc.).

Those having skill in the art will recognize that the state of the art has progressed to the point where there is little distinction left between hardware, software, and/or firmware implementations of aspects of systems; the use of hardware, software, and/or firmware is generally (but not always, in that in certain contexts the choice between hardware and software can become significant) a design choice representing cost vs. efficiency tradeoffs. Those having skill in the art will appreciate that there are various vehicles by which processes and/or systems and/or other technologies described herein can be effected (e.g., hardware, software, and/or firmware), and that the preferred vehicle will vary with the context in which the processes and/or systems and/or other technologies are deployed. For example, if an implementer determines that speed and accuracy are paramount, the implementer may opt for a mainly hardware and/or firmware vehicle; alternatively, if flexibility is paramount, the implementer may opt for a mainly software implementation; or, yet again alternatively, the implementer may opt for some combination of hardware, software, and/or firmware. Hence, there are several possible vehicles by which the processes and/or devices and/or other technologies described herein may be effected, none of which is inherently superior to the other in that any vehicle to be utilized is a choice dependent upon the context in which the vehicle will be deployed and the specific concerns (e.g., speed, flexibility, or predictability) of the implementer, any of which may vary. Those skilled in the art will recognize that optical aspects of implementations will typically employ optically-oriented hardware, software, and or firmware.

Other embodiments and configurations may be devised without departing from the spirit of the invention and the scope of the appended claims.

The invention claimed is:

1. A display system for a vehicle, comprising:

a) a display including a touchscreen input device; and, b) a processing system operatively associated with said display, wherein said display operates in a plurality of fixed modes wherein each fixed mode comprises an operational condition and has a single fixed format, each single fixed format having at least one fixed region, wherein said at least one fixed region has configurable overlay options.

2. The display system of claim 1 wherein said vehicle is an aircraft and said plurality of fixed modes are selected from the group of flight modes consisting of navigation, air-to-air (A-A), emergency, air-to-ground (A-G), preflight checklist and system status.

3. The display system of claim 1 wherein said plurality of fixed modes comprises a navigation mode having a navigation mode format, comprising:

a) an Alphanumeric Control Region;

b) a Primary Flight Region; and, c) an Aircraft Systems Region.

4. The display system of claim 1 wherein said plurality of fixed modes comprises a navigation mode having a navigation mode format, comprising:

a) an Alphanumeric Control Region positioned in a left portion of the display;

b) a Primary Flight Region positioned in a middle portion of the display; and, c) an Aircraft Systems Region positioned in a lower left portion of the display.

5. The display system of claim 4 wherein said Primary Flight Region, comprises:

a) a compass rose positioned in a lower central region of said Primary Flight Region;

b) a course control positioned on one side of said compass rose; and, c) a heading control positioned on another side of said compass rose.

6. The display system of claim 1 wherein said processing system includes a smart control feature which limits controls associated with a display function to only those required in the given fixed mode, wherein when the smart control feature is activated no other display feature can grant access to the same controls.

7. The display system of claim 1 wherein each of said plurality of fixed modes includes an alphanumeric entry region positioned at the same area on the display.

8. The display system of claim 1 wherein one of said at least one fixed region comprises a major aircraft systems health region having components therein displayed only as a function of normal or abnormal status.

9. The display system of claim 1 wherein one of said at least one fixed regions comprises a major aircraft systems health region having components therein displayed as a function of normal or abnormal status, said normal or abnormal status being by color code.

10. The display system of claim 1 wherein major aircraft systems health is displayed as a function of normal or abnormal status.

11. The display system of claim 1, wherein said display has a viewable width greater than 15 inches and a viewable length greater than 5 inches.

12. The display system of claim 1, wherein said display has a viewable width of approximately 20 inches and a viewable length of approximately 8 inches.

13. A display system for a vehicle, comprising:

a) a display including a touchscreen input device; and, b) a processing system operatively associated with said display, wherein said display operates in a plurality of fixed modes wherein each fixed mode has a single fixed format, each single fixed format having at least one fixed region, wherein said at least one fixed region has configurable overlay options wherein said plurality of fixed modes comprises an emergency mode and corresponding fixed emergency mode format, the emergency mode requiring significantly minimized power consumption.

14. The display system of claim 13, wherein said display has a viewable width greater than 15 inches and a viewable length greater than 5 inches.

15. The display system of claim 13, wherein said display has a viewable width of approximately 20 inches and a viewable length of approximately 8 inches.

16. A display system for a vehicle, comprising:

a) a large area display including a touchscreen input device; and, b) a processing system operatively associated with the large area display, wherein said display operates in a plurality of fixed modes wherein each fixed mode comprises an operational condition and has a single fixed format, each single fixed format having at least one fixed region, wherein said plurality of fixed modes comprises an emergency mode and corresponding fixed emergency mode format, the emergency mode requiring significantly minimized power consumption.

17. The display system of claim 16, wherein said large area display has a viewable width greater than 15 inches and a viewable length greater than 5 inches.

18. The display system of claim 16, wherein said large area display has a viewable width of approximately 20 inches and a viewable length of approximately 8 inches.

* * * * *